US009383716B2

(12) United States Patent
Lee et al.

(10) Patent No.: US 9,383,716 B2
(45) Date of Patent: Jul. 5, 2016

(54) CARTRIDGE ASSEMBLY AND SHUTTER ASSEMBLY FOR IMAGE FORMING APPARATUS

(71) Applicant: SINDOH CO., LTD., Seoul (KR)

(72) Inventors: Byoung Bag Lee, Seoul (KR); Goo Chul Jung, Seoul (KR); Jin Sam Park, Seoul (KR); Woo Sung Jung, Seoul (KR)

(73) Assignee: SINDOH CO., LTD., Seoul (KR)

( * ) Notice: Subject to any disclaimer, the term of this patent is extended or adjusted under 35 U.S.C. 154(b) by 0 days.

(21) Appl. No.: 14/834,887

(22) Filed: Aug. 25, 2015

(65) Prior Publication Data

US 2016/0062304 A1 Mar. 3, 2016

(30) Foreign Application Priority Data

Aug. 26, 2014 (KR) ..... 10-2014-0111234
Nov. 24, 2014 (KR) ..... 10-2014-0164344

(51) Int. Cl.
*G03G 21/00* (2006.01)
*G03G 21/10* (2006.01)
*G03G 15/08* (2006.01)

(52) U.S. Cl.
CPC ..... *G03G 21/105* (2013.01); *G03G 15/0886* (2013.01)

(58) Field of Classification Search
CPC .. G03G 21/10; G03G 21/105; G03G 15/0886
See application file for complete search history.

(56) References Cited

U.S. PATENT DOCUMENTS 4,819,030 A * 4/1989 Shibano ..... G03G 21/007 399/360
4,899,690 A * 2/1990 Hacknauer ..... G03G 15/0844 399/120
5,017,962 A * 5/1991 Tsuji ..... G03G 21/1814 399/120
5,036,369 A * 7/1991 Toda ..... G03G 21/105 399/222
5,079,593 A * 1/1992 Satoh ..... G03G 15/0822 399/111
5,128,724 A * 7/1992 Hayashi ..... G03G 21/105 399/199
5,200,787 A * 4/1993 Nishiguchi ..... G03G 15/0822 399/359
5,204,720 A * 4/1993 Ishida ..... G03G 15/0868 399/256
5,206,692 A * 4/1993 Ishida ..... G03G 21/12 399/258

(Continued)

*Primary Examiner* — David Bolduc
(74) *Attorney, Agent, or Firm* — Nixon & Vanderhye P.C.

(57) ABSTRACT

A cartridge assembly for an image forming apparatus, including a drum unit provided with a waste toner conveyor which conveys waste toner collected from a surface of a photosensitive drum to one side; a developing unit connected with the drum unit, configured to receive the waste toner collected from the drum unit, and having a developer discharger to discharge a developer therein to an outside; and a developer collecting unit integrally formed with the drum unit at one side of the drum unit, and configured to collect the developer discharged by the developer discharger of the developing unit, wherein the drum unit includes a toner injector which connects the waste toner conveyor, a new toner supply unit and the developing unit so that the waste toner conveyed by the waste toner conveyor and new toner supplied from the new toner supply unit are injected together into the developing unit.

7 Claims, 9 Drawing Sheets

(56) References Cited

U.S. PATENT DOCUMENTS 5,289,249 A * 2/1994 Yamamoto ..... G03G 21/105 399/359
5,381,217 A * 1/1995 Ishida ..... G03G 21/12 399/120
5,398,098 A * 3/1995 Fukunaga ..... G03G 15/0844 399/110
5,440,376 A * 8/1995 Hagihara ..... G03G 15/0844 399/120
5,493,382 A * 2/1996 Takagaki ..... G03G 21/105 399/359
5,592,270 A * 1/1997 Takai ..... G03G 15/0844 399/260
5,734,957 A * 3/1998 Ogawa ..... G03G 21/105 399/255
5,737,668 A * 4/1998 Johroku ..... G03G 21/12 399/120
5,781,841 A * 7/1998 Kouroku ..... G03G 21/12 399/35
5,849,453 A * 12/1998 Mikuriya ..... G03G 13/09 399/359
5,878,317 A * 3/1999 Masuda ..... G03G 21/105 399/120
5,950,055 A * 9/1999 Yahata ..... G03G 15/0822 399/252
5,950,062 A * 9/1999 Yahata ..... G03G 21/105 399/358
6,167,227 A * 12/2000 Fujita ..... G03G 15/0877 399/258
6,347,199 B1 * 2/2002 Morihara ..... G03G 15/0126 399/224
6,567,631 B2 * 5/2003 Funayama ..... G03G 21/12 399/120
6,587,661 B1 * 7/2003 Shimmura ..... G03G 15/0844 399/257
6,625,404 B2 * 9/2003 Watanabe ..... G03G 15/0806 399/260
6,711,374 B2 * 3/2004 Funayama ..... G03D 3/00 399/120
7,890,022 B2 * 2/2011 Kweon ..... G03G 15/0898 399/120
7,917,076 B2 * 3/2011 Inoue ..... G03G 21/12 399/358
8,005,383 B2 * 8/2011 Tanaka ..... G03G 15/105 399/233
2002/0067932 A1 * 6/2002 Arai ..... G03G 21/105 399/253
2005/0265759 A1 * 12/2005 Takeuchi ..... G03G 21/105 399/359
2006/0062614 A1 * 3/2006 Choi ..... G03G 21/105 399/358
2006/0078361 A1 * 4/2006 Park ..... G03G 21/105 399/359
2006/0083552 A1 * 4/2006 Yoshimoto ..... G03G 21/12 399/257
2008/0056772 A1 * 3/2008 Utsumi ..... G03G 15/0872 399/254
2008/0199234 A1 * 8/2008 Hagi ..... G03G 21/12 399/359
2008/0240779 A1 * 10/2008 Ogashiwa ..... G03G 21/12 399/119
2009/0022531 A1 * 1/2009 Kubota ..... G03G 15/0894 399/359
2009/0110425 A1 * 4/2009 Uno ..... G03G 15/0868 399/61
2009/0129820 A1 * 5/2009 Kohno ..... G03G 15/0877 399/254
2010/0008701 A1 * 1/2010 Izumi ..... G03G 15/0849 399/257
2010/0074646 A1 * 3/2010 Miyahara ..... G03G 15/168 399/99
2010/0215398 A1 * 8/2010 Iikura ..... G03G 21/12 399/111
2010/0322666 A1 * 12/2010 Inomata ..... G03G 15/0896 399/120
2011/0085835 A1 * 4/2011 Sato ..... G03G 21/12 399/360
2011/0158723 A1 * 6/2011 Yokokawa ..... G03G 21/105 399/358
2011/0229209 A1 * 9/2011 Takaya ..... G03G 15/0844 399/257
2013/0183065 A1 * 7/2013 Nakamura ..... G03G 15/0844 399/258
2014/0140725 A1 * 5/2014 Kawasumi ..... G03G 15/0879 399/119

* cited by examiner

CARTRIDGE ASSEMBLY AND SHUTTER ASSEMBLY FOR IMAGE FORMING APPARATUS

This application claims priority to KR Patent Application No. 10-2014-0111234 filed 26 Aug. 2014, and KR Patent Application No. 10-2014-0164344 filed 24 Nov. 2014, the entire contents of each of which are hereby incorporated by reference.

TECHNICAL FIELD

The present invention relates to a cartridge assembly and a shutter assembly for an image forming apparatus.

BACKGROUND ART

An image forming apparatus such as a copy machine, a printer and a multifunction printer is classified into an ink-jet type, an electro-photographic type and a thermal transfer type according to an image forming method. In the electro-photographic image forming apparatus, an image is formed on a printing medium through a series of processes such as charging, exposing, developing, transferring and fixing.

A conventional electro-photographic image forming apparatus is configured with a cartridge assembly in which a drum unit and a developing unit are integrally formed, wherein the drum unit has a photosensitive drum, a charging roller, a transfer roller and so on, and the developing unit accommodates a developer therein and has a developing roller and a supply roller.

Here, the cartridge assembly has a developer comprised of toner and carrier for a printing operation. The developer should be replenished or replaced due to consumption of the toner resulting from printing operation.

Formerly, the replenishment or replacement of the developer was performed by collecting and discharging a waste developer, i.e., waste toner and waste carrier simultaneously and then replenishing a new developer. However, in such a developer replenishing or replacing method, a large amount of the developer is abandoned, and a separate waste developer receiving part is required.

In Japanese Patent Publication No. 1993-66659 (Patent document 1), there is disclosed an image forming apparatus in which the toner is collected and reused in consideration of a conventional developer consumption. Patent document 1 discloses a process cartridge in which a waste toner tank is integrally installed at a photosensitive drum, and a discharging system for collecting the waste toner in the waste toner tank into a developing machine is installed.

However, according to patent document 1, a toner consumption may be reduced by collecting and reusing the toner, but there is a problem in that the quality of an image is degraded over time by reduction of the carrier and deterioration of the developer which result from long-term use.

Meanwhile, in Japanese Patent Publication No. 2001-194908 (Patent document 2), there is disclosed an image forming apparatus in which the toner is collected and reused, and a supply amount of the carrier is controlled. Therefore, it is possible to solve the carrier reduction problem in Patent document 1.

However, in Patent document 2, since there is not a separate developer discharging structure other than a structure for scraping the developer remaining in the drum and collecting the developer, there is a problem in that the quality of an image is degraded by deterioration of the developer due to long-term use, and a separate toner and carrier receiving part is required.

Also, in the image forming apparatuses of the above-described patent documents, when it is necessary to disassemble or detach a drum unit, a developing unit, a developer collecting unit and a main body of the image forming apparatus which are independently or integrally formed, a shutter is installed at a moving route of the developer. Here, a unit for collecting the developer is assembled or detach in a lengthwise direction of a unit for discharging the developer or from a lower side thereof. At this time, the shutter is opened and closed, and thus some of the developer drops down. That is, in the conventional image forming apparatus, there is a problem in that the developer leaks when the units or the unit and the main body are detach from each other.

DISCLOSURE

Technical Problem

The present invention is directed to providing a cartridge assembly for an image forming apparatus capable of reusing collected toner together with new toner and simultaneously discharging a developer, and thus reducing toner consumption, and also preventing the quality of a printed image from being degraded.

Also, the present invention is directed to providing a shutter assembly for an image forming apparatus capable of preventing a shutter from being opened when assembling and detaching a cartridge assembly, and thus preventing a developer from leaking.

Technical Solution

One aspect of the present invention provides a cartridge assembly for an image forming apparatus, including a drum unit provided with a waste toner conveying means which conveys waste toner collected from a surface of a photosensitive drum to one side; a developing unit connected with the drum unit, configured to receive the waste toner collected from the drum unit, and having a developer discharging means to discharge a developer therein to an outside; and a developer collecting unit integrally formed with the drum unit at one side of the drum unit, and configured to collect the developer discharged by the developer discharging means of the developing unit, wherein the drum unit includes a toner injecting means which connects the waste toner conveying means, a new toner supply unit and the developing unit so that the waste toner conveyed by the waste toner conveying means and new toner supplied from the new toner supply unit are injected together into the developing unit.

The developer discharging means may include a first conveying screw installed at an inside of the developing unit in a lengthwise direction of the developing unit, a developer discharging channel which is in communication with the developing unit and the developer collecting unit at an upper portion of one side of the developing unit, and a second conveying screw installed at an inside of the developer discharging channel in a lengthwise direction of the developer discharging channel.

The drum unit may further include a cleaning means which collects the toner remaining on the surface of the photosensitive drum.

The developer collecting unit may have a guide groove corresponding to a shape of a side surface of the developing unit at a side surface thereof facing the developing unit.

Another aspect of the present invention provides a shutter assembly which is installed at the cartridge assembly to control an introduction of a developer, including a developer collecting member formed at a side surface of the develop collecting unit, and having a developer collecting hole; a developer discharging member rotatably provided at an end of the developer discharging means, and having a developer discharging hole at a side surface thereof; and a rotating member rotatably installed at the side surface of the developer collecting unit, and configured to allow the developer discharging hole of the developer discharging member to be selectively in communication with the developer collecting hole.

The developer collecting member may include a first seating part which is concave toward the developer collecting unit, and the developer collecting hole may be formed at a lower portion of the first seating part and is longitudinally in communication with the first seating part, and the first seating part and the developer collecting hole may have a quarter-circular shape.

The rotating member may include a disk-shaped base having a rotating shaft which is rotatably inserted into a side surface of the developer collecting unit; and a second seating part having a shape corresponding to the first seating part, and an opening may be formed at a side end of the second seating part.

The developer discharging member may be seated at the second seating part to have a shape corresponding to the second seating part, and due to rotation of the rotating member, the developer discharging hole may be closed by the first seating part, or may deviate from the first seating part to be opened.

The rotating member may further include a first elastic member which is connected with the rotating shaft and returns the rotating member to its original position.

The developer discharging member may further include a second elastic member which is connected with the developer discharging means and returns the developer discharging means to its original position.

The shutter assembly may further include a lever member which is connected with the rotating member, and pressed by an image forming apparatus to rotate the rotating member, when the cartridge assembly is installed at the image forming apparatus.

Advantageous Effects

According to the present invention, it is possible to reduce toner consumption and to prevent the quality of the printed image from being degraded. Also, since the developer collecting unit is integrally formed with the drum unit, an entire size of the image forming apparatus can be reduced, and also the waste developer can be easily managed.

MODES OF THE INVENTION

Figure 1:
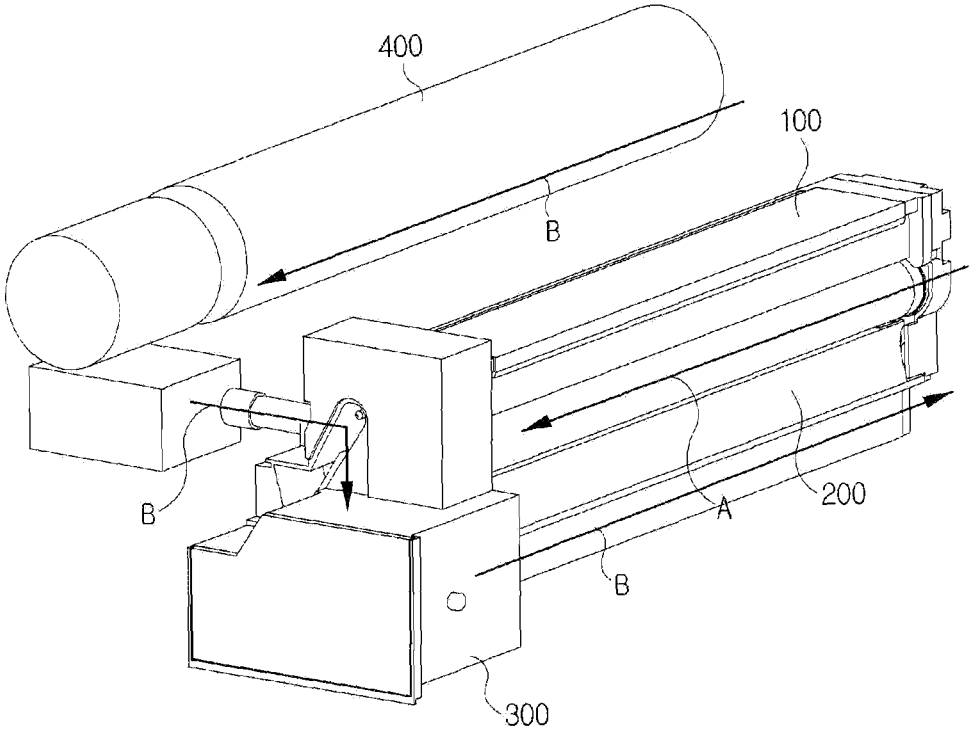
FIG. 1 is a perspective view illustrating a cartridge assembly for an image forming apparatus according to the present invention.
Figure 2:
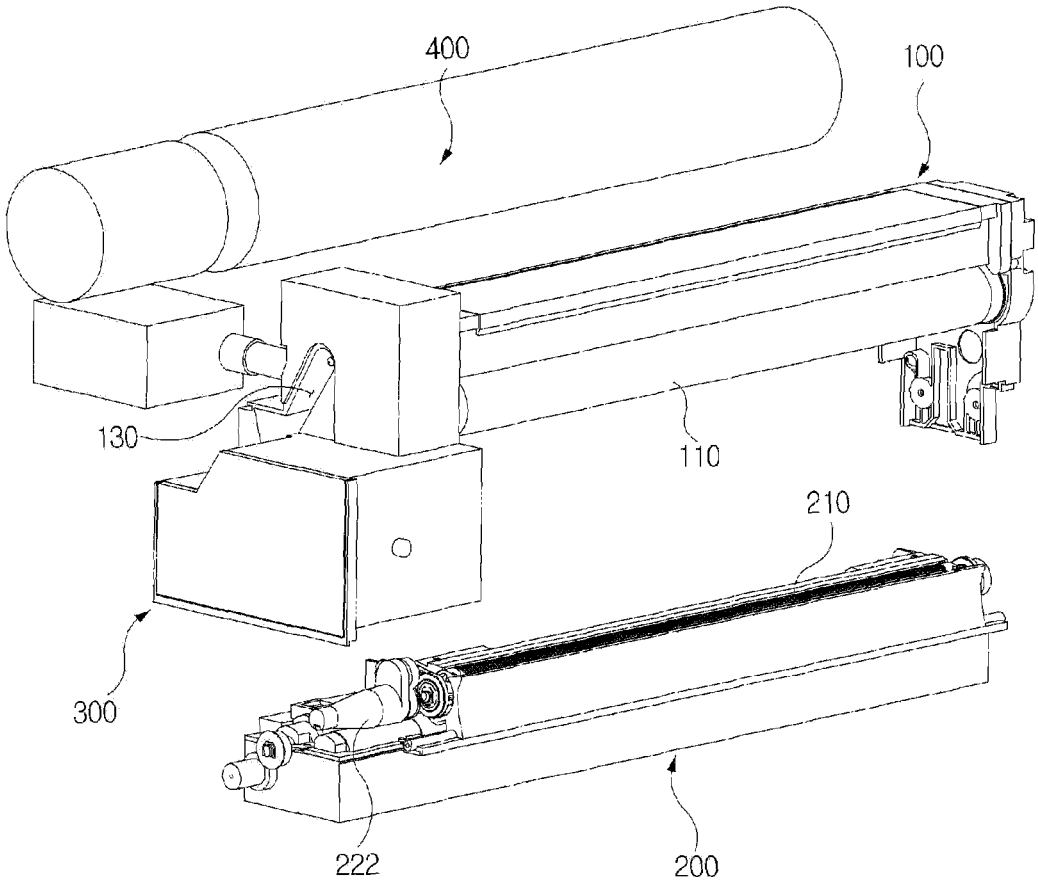
FIG. 2 is an exploded perspective view illustrating in a different direction the cartridge assembly for the image forming apparatus according to the present invention.
Figure 3:
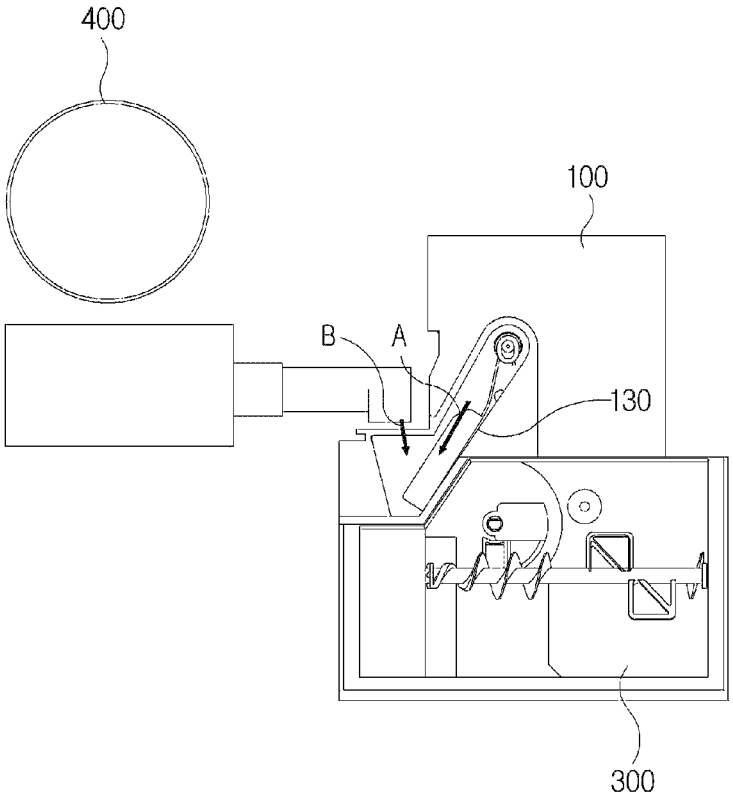
FIG. 3 is a side view illustrating the cartridge assembly for the image forming apparatus according to the present invention.

Referring to FIGS. 1 to 3, a cartridge assembly for an image forming apparatus according to the present invention includes a drum unit 100 and a developing unit 200 which are installed at an inside of the image forming apparatus to form an image, and a developer collecting unit 300 which collects a developer in the developing unit 200.

The drum unit 100 includes components such as a photosensitive drum, a charging roller and a transfer roller to form a latent image. Also, the drum unit 100 includes a waste toner conveying means 120 which conveys waste toner collected from a surface of the photosensitive drum 110 to one side of the drum unit 100.

The developing unit 200 is provided with a developing roller 210 which supplies the developer to the latent image formed on the photosensitive drum 110, and also coupled with the drum unit 100 so that the developing roller 210 is in contact with the photosensitive drum 110 of the drum unit 100. Also, the developing unit 200 is configured to receive the waste toner collected from the drum unit 100 into an inside of the developing unit 200. And the developing unit 200 is provided with a developer discharging means 220 which discharges the developer therein to an outside.

The developer collecting unit 300 is integrally formed with the drum unit 100 at one side of the drum unit 100, i.e., at one end of the drum unit 100 which is located in a direction that the waste toner is collected from the drum unit 100. The developer collecting unit 300 serves to collect the developer discharged by the developer discharging means 220 of the developing unit 200.

Figure 4:
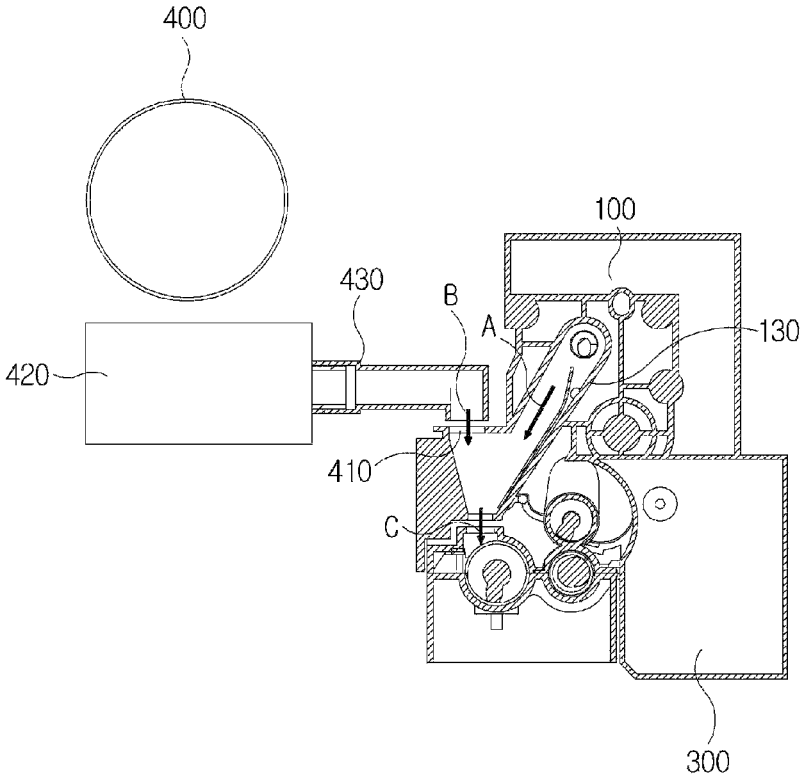
FIG. 4 is a side view enlargedly illustrating an internal structure of the cartridge assembly for the image forming apparatus according to the present invention.
Figure 5:
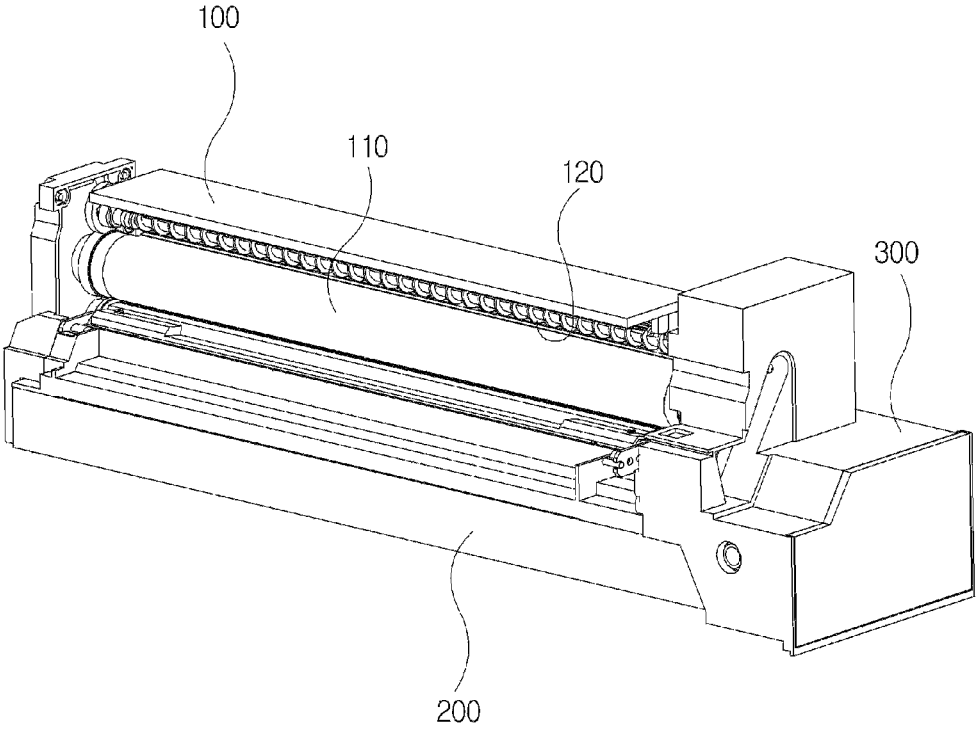
FIG. 5 is a perspective view illustrating in another different direction the cartridge assembly for the image forming apparatus according to the present invention.

Referring to FIGS. 4 and 5, the waste toner conveying means 120 provided at the drum unit 100 is configured with a conveying screw which is installed at an inside of the drum unit 100 in a lengthwise direction of the drum unit 100. The waste toner conveying means 120 conveys the waste toner collected from the photosensitive drum 110 to the developer collecting unit 300. The drum unit 100 has a toner injecting means 130 for injecting the collected waste toner into the developing unit 200. Here, the toner injecting means 130 is configured to inject the waste toner together with new toner into the developing unit 200.

Specifically, the toner injecting means 130 is connected with a new toner supply unit 400 installed at an outside of the drum unit 100, more exactly, an injection port 410 of the new toner supply unit 400, and connected with the waste toner conveying means 120, and also connected with the developing unit 200 (referring to FIG. 4). The new toner supply unit 400 includes a hopper 420 which discharges the new toner therein to an outside, a new toner conveying passage 430 through which the new toner discharged to the hopper 420 is conveyed, and the injection port 410 which is connected with the toner injecting means 130 to inject the new toner conveyed through the new toner conveying passage 430 into the toner injecting means 130.

The waste toner conveyed from the waste toner conveying means 120 by the toner injecting means 130 and the new toner supplied from the new toner supply unit 400 may be injected together into the developing unit. In FIG. 4, a yellow arrow A indicates a moving route of the waste toner, a arrow B indicates a moving route of the new toner, and a blue arrow C indicates a mixed toner in which the new toner and the waste toner are mixed.

Meanwhile, although not shown specifically in the drawings, a cleaning means (not shown) which scrapes and collects the waste toner remaining on the surface of the photosensitive drum 110 is provided at one side of the drum unit 100. The cleaning means may be configured with a cleaning blade. The waste toner conveying means 120 conveys the waste toner collected by the cleaning means toward the toner injecting means 130.

Figure 6:
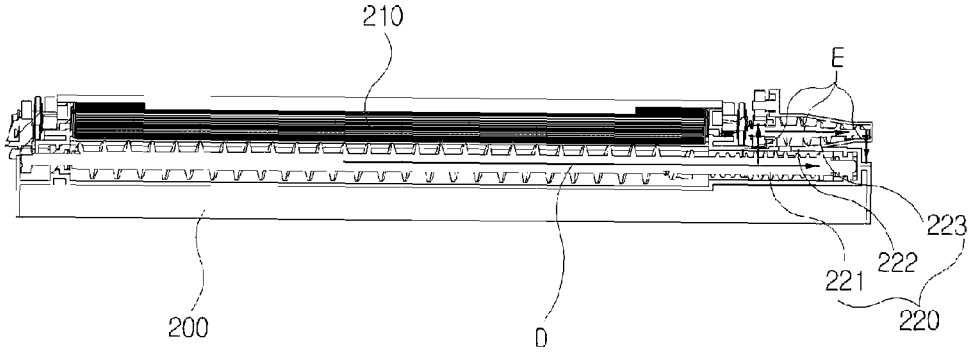
FIG. 6 is a cross-sectional view enlargedly illustrating a developer discharging means of the cartridge assembly for the image forming apparatus according to the present invention.

Referring to FIG. 6, the developer discharging means 220 includes a first conveying screw 221, a developer discharging channel 222 and a second conveying screw 223. The first conveying screw 221 is installed at the inside of the developing unit 200 in a lengthwise direction of the developing unit 200. The developer discharging channel 222 is in communication with the developing unit 200 and the developer collecting unit 300 at an upper portion of one side (i.e., the developer collecting unit 300 side) of the developing unit 200. Here, a lower portion of one end of the developer discharging channel 222 is in communication with the developing unit 200, and a lower portion of the other end thereof is connected with the developer collecting unit 300. The second conveying screw 223 is installed at an inside of the developer discharging channel 222 in a lengthwise direction of the developer discharging channel 222. In FIG. 6, a blue arrow D indicates a moving route of the developer conveyed by the first conveying screw 221, and a arrows E indicate a moving route of the developer conveyed by the second conveying screw 223.

Due to the developer discharging means 220, the developer located in the developing unit 200 is conveyed toward the developer discharging channel 222 by the first conveying screw 221, and when the developer located in the developing unit 200 exceeds a predetermined level, the developer is introduced into the developer discharging channel 222 by the second conveying screw 223 and then collected in the developer collecting unit 300.

As described above, the cartridge assembly for the image forming apparatus according to the present invention may reduce a toner consumption by collecting the waste toner through the toner injecting means 130 and supplying the waste toner together with the new toner, and also may discharge the developer deteriorated in the developing unit 200 to the developer collecting unit 300, and thus may solve the problem that the quality of the printed image is degraded.

Also, as described above, since the developer collecting unit 300 is integrally formed with the drum unit 100, when a life span of the drum unit 100 (a life span of the cleaning means) ends and thus the drum unit 100 is replaced, the developer collecting unit 300 is also replaced together with the drum unit 100. Therefore, the waste developer may be treated according to the life span of the drum unit 100. Like this, since replacement periods of the drum unit 100 and the developer collecting unit 300 are the same as each other, the waste developer may be easily managed.

Also, the above-described integral structure of the drum unit 100 and the developer collecting unit 300 has an effect of reducing an entire size of the apparatus.

Figure 7:
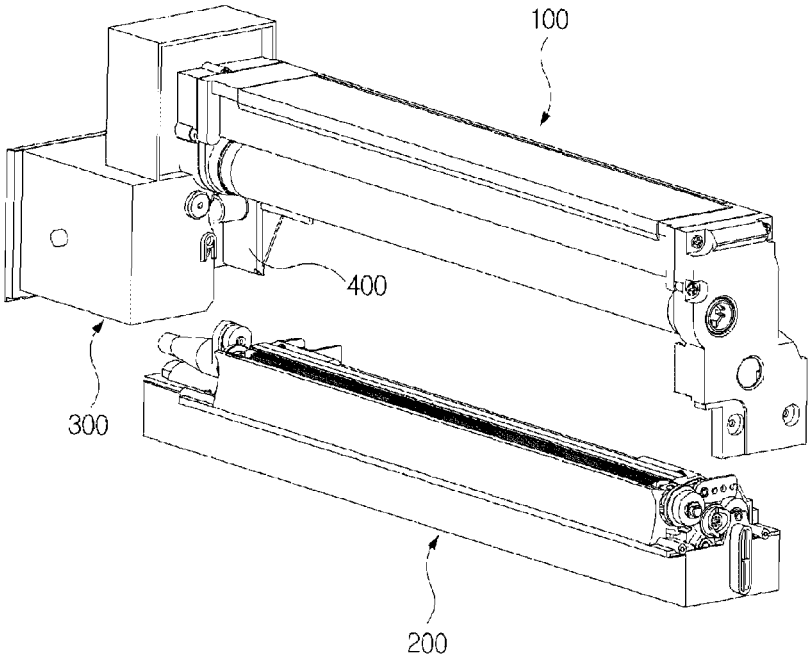
FIG. 7 is an exploded perspective view illustrating a drum unit and a developing unit of the cartridge assembly for the image forming apparatus according to the present invention.

Meanwhile, referring to FIG. 7, the developer collecting unit 300 integrally formed with the drum unit 100 has a guide groove 310 corresponding to a shape of a side surface of the developing unit 200 at a side surface thereof facing the developing unit 200. And a guide groove (not shown) corresponding to the shape of the side surface of the developing unit 200 is also provided at a side surface of the drum unit 100 facing the developer collecting unit 300.

Like this, the developing unit 200 may be easily coupled to the drum unit 100 by the guide groove 310 of the developer collecting unit 300.

Hereinafter, the operation of the cartridge assembly for the image forming apparatus according to the present invention will be described with the accompanying drawings.

First, the waste toner collected from the photosensitive drum 110 by the cleaning means is conveyed toward the toner injecting means 130 of the drum unit 100 by the waste toner conveying means 120 of the drum unit 100. At the same time, the new toner of the new toner supply unit 400 is supplied to the toner injecting means 130 through the hopper 420, the new toner conveying passage 430 and the injection port 410. Therefore, the collected waste toner and the new toner are simultaneously introduced into the toner injecting means 130. A mixture of the waste toner and the new toner of the toner injecting means 130 is injected into the developing unit 200 by a conveying screw (a separate conveying screw from the first conveying screw 221) installed at the inside of the developing unit 200. In FIGS. 1 and 3, the yellow arrow A indicates the moving route of the waste toner, and the arrow B indicates the moving route of the new toner.

Therefore, in the present invention, since the new toner and the waste toner are mixed by the toner injecting means 130 and then used, the toner consumption may be reduced.

Further, the developer in the developing unit 200 is conveyed toward the developer discharging channel 222 through the first conveying screw 221. And when the developer in the developing unit 200 exceeds the predetermined level, the developer is introduced into the developer discharging channel 222 by the second conveying screw 223, and then collected in the developer collecting unit 300.

Therefore, since some of the developer deteriorated in the developing unit 200 is discharged to the developer collecting unit 300, the problem that the quality of the printed image is degraded may be solved.

Meanwhile, the developer collected in the developer collecting unit 300 is collected and stays in the developer collecting unit 300 until the life span of the drum unit 100 ends, and then is abandoned when the drum unit 100 is replaced. Therefore, treatment and management of the waste developer may be easily performed.

Figure 8:
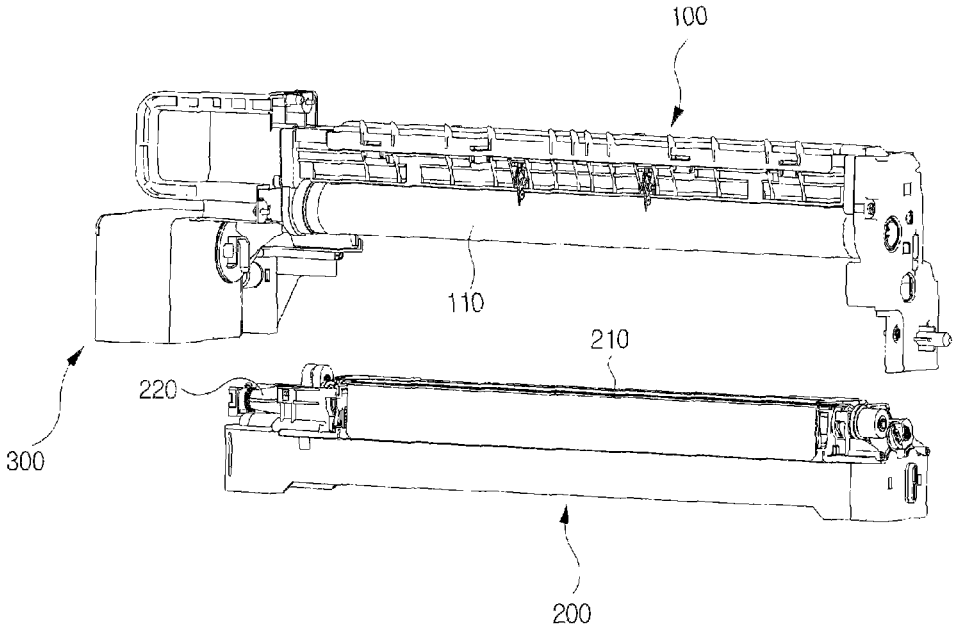
FIG. 8 is an exploded perspective view illustrating a cartridge assembly in which a shutter assembly for an image forming apparatus according to the present invention is installed.

Referring to FIG. 8, the cartridge assembly at which a shutter assembly for an image forming apparatus according to the present invention is installed includes a drum unit 100 and a developing unit 200 which are installed at an inside of the image forming apparatus to form an image. A developer collecting unit 300 which collects a developer in the developing unit 200 is installed at one side of the drum unit 100.

The drum unit 100 includes components such as a photosensitive drum, a charging roller and a transfer roller to form a latent image. Also, the drum unit 100 has a waste toner conveying passage(not shown) therein to convey the waste toner collected from a surface of the photosensitive drum 110 to one side of the drum unit 100.

The developing unit 200 is provided with a developing roller 210 which supplies the developer to the latent image formed on the photosensitive drum 110, and also coupled with the drum unit 100 so that the developing roller 210 is in contact with the photosensitive drum 110 of the drum unit 100.

Figure 9:
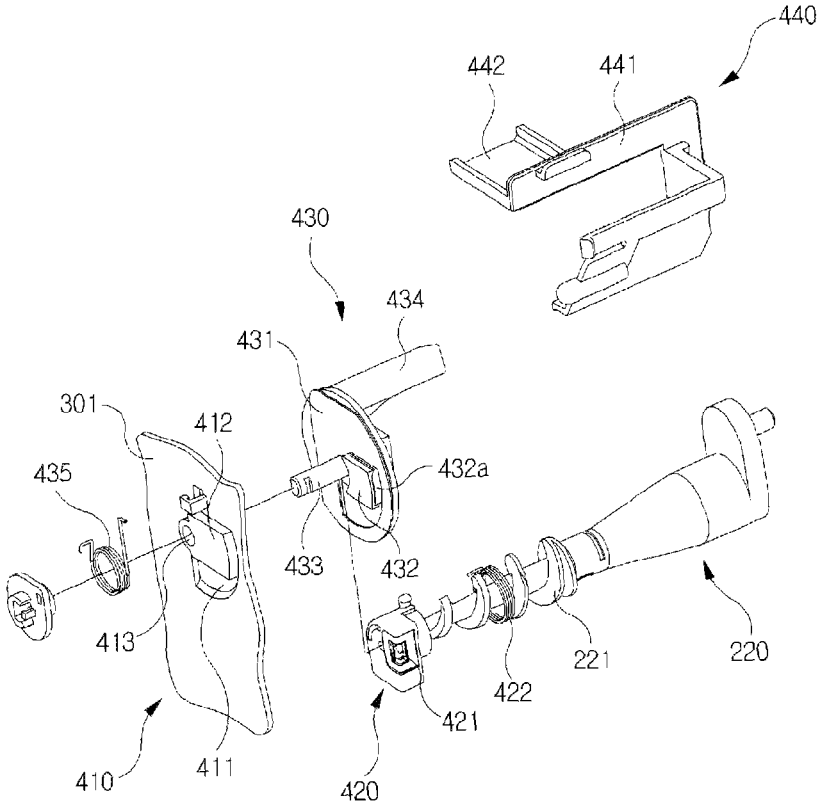
FIG. 9 is an exploded perspective view illustrating the shutter assembly for the image forming apparatus according to the present invention.
Figure 10:
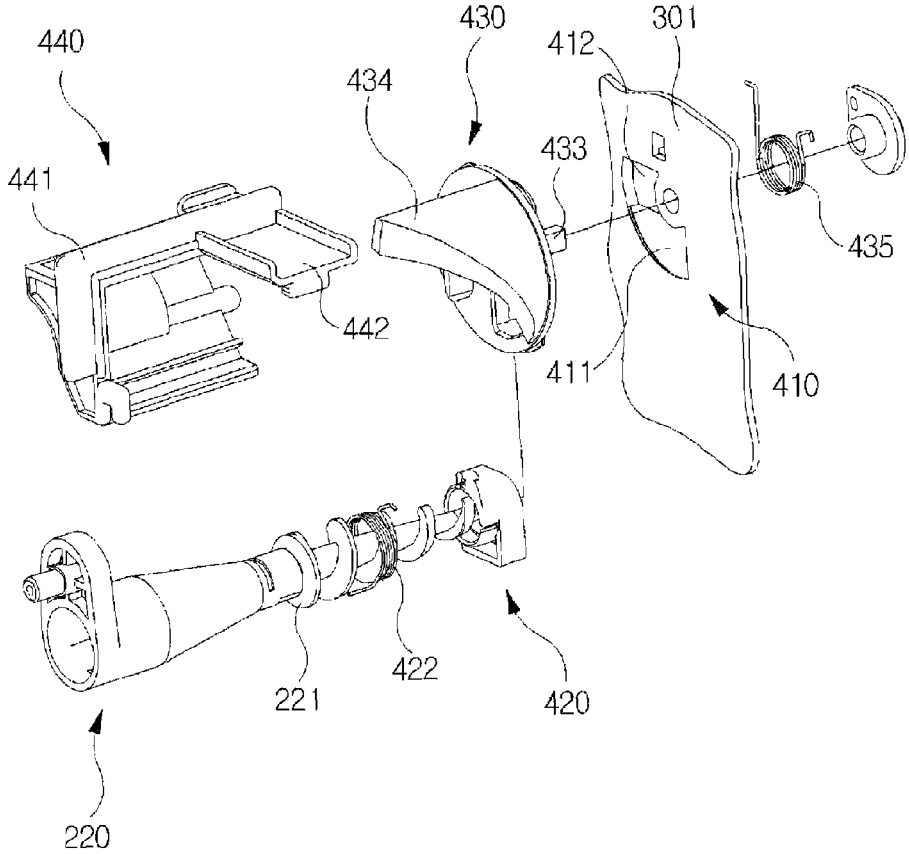
FIG. 10 is an exploded perspective view illustrating in a different direction the shutter assembly for the image forming apparatus according to the present invention.
Figure 11A:
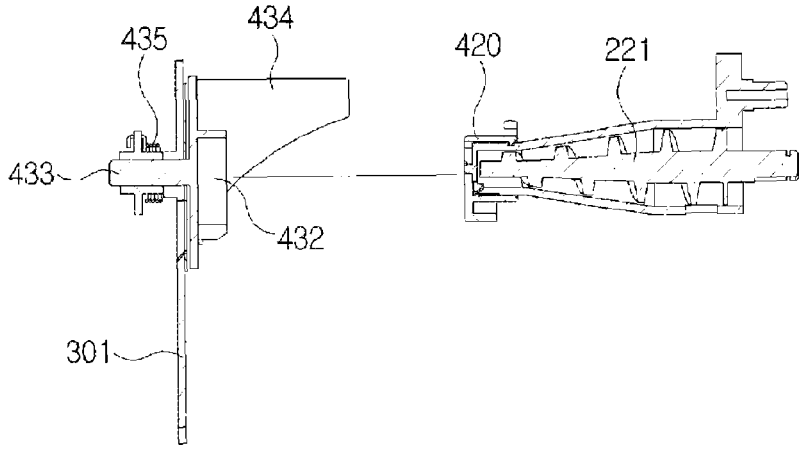
FIG. 11A is an exploded cross-sectional view illustrating a closed state of the shutter assembly for the image forming apparatus according to the present invention.
Figure 11B:
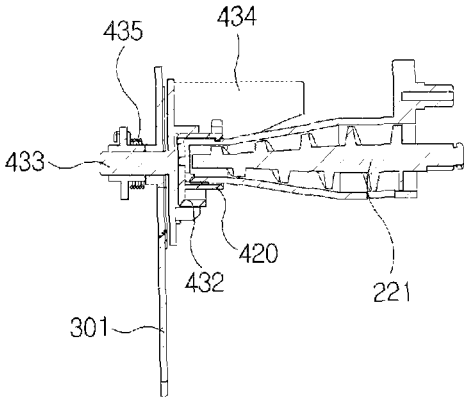
FIG. 11B is a cross-sectional view illustrating the closed state of the shutter assembly for the image forming apparatus according to the present invention.
Figure 12A:
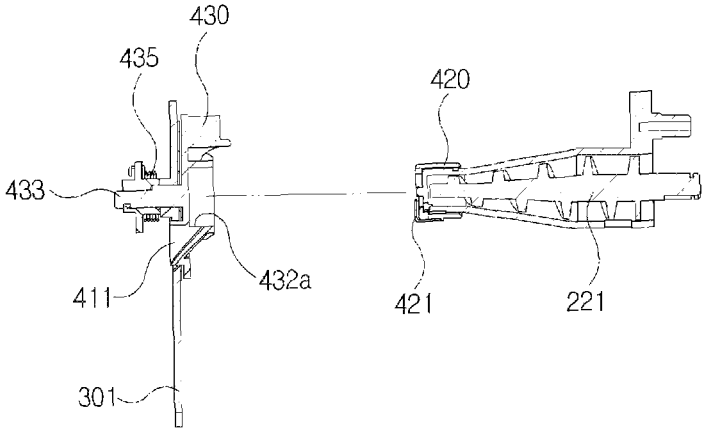
FIG. 12A is an exploded cross-sectional view illustrating an opened state of the shutter assembly for the image forming apparatus according to the present invention.
Figure 12B:
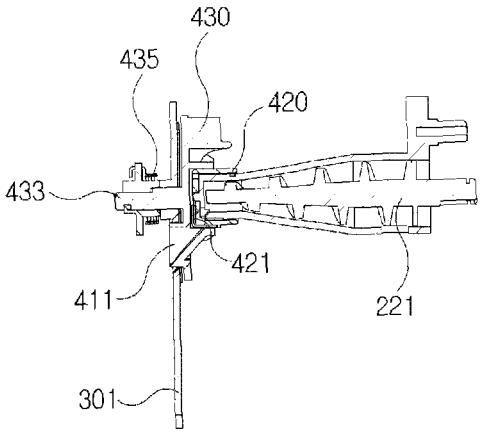
FIG. 12B is a cross-sectional view illustrating the opened state of the shutter assembly for the image forming apparatus according to the present invention.

Also, the developing unit 200 is configured to receive the waste toner collected from the drum unit 100 into an inside of the developing unit 200. And the developing unit 200 is provided with a developer discharging means 220 which discharges the developer therein to an outside. The developer discharging means 220 is provided with a conveying screw 221 (referring to FIGS. 9 and 10).

The developer collecting unit 300 is integrally formed with the drum unit 100 at one side of the drum unit 100, i.e., at one end of the drum unit 100 which is located in a direction that the waste toner is collected from the drum unit 100. The developer collecting unit 300 serves to collect the developer discharged by the developer discharging means 220 of the developing unit 200.

Referring to FIGS. 9 to 12*b*, the shutter assembly for the image forming apparatus according to the present invention is installed between the developing unit 200 and the developer collecting unit 300 to selectively open and close a developer returning passage between the developing unit 200 and the developer collecting unit 300 to supply and collect the developer.

Specifically, the shutter assembly for the image forming apparatus according to the present invention includes a developer collecting member 410, a developer discharging member 420 and a rotating member 430.

The developer collecting member 410 is formed at a side surface 301 of the developer collecting unit 300, more exactly, at a side surface thereof facing the developing unit 200, and has a developing collecting hole 411 through which the developer of the developing unit 200 is collected.

The developer discharging member 420 is rotatably provided at an end of the developer discharging means 220, more exactly, at an end thereof facing the developer collecting unit 300, and has a developer discharging hole 421 formed at one side surface thereof. The developer discharging member 420 is inserted into the developer collecting hole 411 of the developer collecting member 410 to selectively discharge the developer of the developer unit 200 toward the developer collecting unit 300.

The rotating member 430 is rotatably installed at the side surface 301 of the developer collecting unit 300. The rotating member 430 serves to allow the developer discharging hole 421 of the developer discharging member 420 to be selectively in communication with the developer collecting hole 411, while being rotated. That is, due to rotation of the rotating member 430, the developer discharging hole 421 and the developer collecting hole 411 are selectively aligned with each other to control a discharge of the developer.

Here, the developer collecting member 410 includes a first seating part 412 which is concave toward the developer collecting unit 300. The first seating part 412 has a groove shape of which an upper surface and side surfaces are closed and a lower surface is opened. Also, the developer collecting hole 411 is formed at a lower portion of the first seating part 412 to be longitudinally in communication with the first seating part 412.

At this time, the first seating part 412 and the developer collecting hole 411 generally has a quarter-circular shape. Such a shape of the developer collecting member 410 is for smoothly rotating the rotating member 430 and for selectively opening and closing the developer discharging member 420.

The rotating member 430 includes a disk-shaped base 431 and a second seating part 432. The base 431 has a rotating shaft 433 provided at a center thereof. The rotating shaft 433 is rotatably inserted into the side surface 301 of the developer collecting unit 300, more exactly, into a coupling hole 413 of the first seating part 412. Also, an arm 434 extending in an opposite direction to the rotating shaft 433 is provided at an outer circumferential side of the base 431. The second seating part 432 is formed in a shape corresponding to the first seating part 412, and thus when the rotating member 430 is installed at the developer collecting member 410, the first and second seating parts 412 and 432 are located to be overlapped with each other. Here, an opening 432*a* which is in communication with an outside is formed at a side end of the second seating part 432. The opening 432*a* is aligned with the developer discharging hole 421 of the developer discharging member 420, and serves to discharge the developer.

Also, the developer discharging member 420 has a shape corresponding to the second seating part 432, and is seated at the second seating part 432. When the rotating member 430 is rotated while the developer discharging member 420 seated at the second seating part 432, the developer discharging member 420 is rotated together with the rotating member 430. Thus, the developer discharging hole 421 and the opening 432*a* are located toward the lower portion of the first seating part 412. Therefore, due to the rotation of the rotating member 430, the developer discharging hole 421 may be closed by the first seating part 412, or may deviate from the first seating part 412 to be opened. That is, the developer discharging hole 421 is in communication with the developer collecting hole 411, and thus the developer returning passage formed between the developer unit 200 and the developer collecting unit 300 is selectively opened and closed.

Also, the shutter assembly according to the present invention further includes a lever member 440 which is connected with the rotating member 430 to rotate the rotating member 430. This lever member 440 is provided with a pressing surface 441 which is contact with an arm 434 of the rotating member 430. The lever member 440 is provided with a pressing lever 442 which extends from a pressing surface 441 toward one side and is in contact with an internal component (not shown) of the image forming apparatus. When the cartridge assembly is installed at the image forming apparatus, the pressing lever 442 is in contact with and pressed by the internal component of the image forming apparatus, and thus the pressing surface 441 pushes the arm 434 of the rotating member 430 to rotate the rotating member 430.

Here, the developer discharging hole 421 of the developer discharging member 420 and the opening 432*a* of the rotating member 430 are designed to be located in a lateral direction, i.e., a horizontal direction, when the drum unit 100 and the developing unit 200 are assembled. Therefore, when the drum unit 100 and the developing unit 200 are assembled, the developer returning passage is blocked by a side surface of the first seating part 412, and thus is in a closed state. Therefore, a leakage of the developer is prevented.

Then, when the cartridge assembly is installed at the image forming apparatus, the rotating member 430 is rotated by the lever member 440, and the developer discharging hole 421 of the developer discharging member 420 and the opening 432*a* of the rotating member 430 are located downward toward the developer collecting hole 441 of the developer collecting member 410, i.e., toward the lower portion of the first seating part 412. Therefore, the developer returning passage is opened.

As described above, since the shutter assembly for the image forming apparatus according to the present invention may close the developer returning passage before the cartridge assembly is installed, and may open the developer returning passage after the cartridge assembly is installed, the leakage of the developer may be prevented.

Preferably, the rotating member 430 further includes a first elastic member 435 which is connected with the rotating shaft 433 and returns the rotating member 430 to its original position. The first elastic member 435 may be a torsion spring which applies an elastic force so that the opening 432*a* of the rotating member 430 is located in the horizontal direction when the cartridge assembly is not installed at the image forming apparatus.

Also, the developer discharging member 420 further includes a second elastic member 422 which is connected with the developer discharging means 220 and returns the developer discharging member 420 to its original position. The second elastic member 422 may be a torsion spring which applies an elastic force so that the developer discharging hole 421 is located in the horizontal direction when the cartridge assembly is not installed at the image forming apparatus.

Hereinafter, the operation of the shutter assembly for the image forming apparatus according to the present invention will be described with reference to the accompanying drawings.

First, when the drum unit 100 and the developing unit 200 are assembled, the developer discharging member 420 is seated at the second seating part 432 of the rotating member 430, while the first seating part 412 of the developer collecting member 410 and the second seating part of the rotating member 430 are overlapped with each other. Then, the developer discharging hole 421 of the developer discharging member 420 and the opening 432*a* of the rotating member 430 are not in communication with the developer collecting hole 411 of the developer collecting member 410, but is located in the horizontal direction. That is, the developer discharging hole 421 of the developer discharging member 420 and the opening 432*a* of the rotating member 430 are blocked by the side surface of the first seating part 412, and thus are in the closed state. Therefore, the developer in the developer unit 200 does not leak to the outside through the developer discharging hole 421 (referring to FIGS. 11A and 11B).

And when the drum unit 100 and the developing unit 200 are assembled, and thus the completed cartridge assembly is installed at the image forming apparatus, the pressing lever 442 of the lever member 440 is pressed by the internal component of the image forming apparatus, and thus the lever member 440 is rotated to one side. Then, the pressing surface 441 of the lever member 440 pushes the arm 434 of the rotating member 430, and thus the rotating member 430 is rotated to one side. Here, the lever member 440 and the rotating member 430 are designed to be rotated downward at an angle of 90 degrees when the cartridge assembly is installed (referring to FIGS. 12A and 12B).

Accordingly, the developer discharging hole 421 of the developer discharging member 420 and the opening 432*a* of the rotating member 430 are located downward, and are in communication with the developer collecting hole 411 of the developer collecting member 410. Therefore, the developer of the developing unit 100 may be conveyed to the developer collecting unit 300 through the developer returning passage.

Also, when the installed cartridge assembly is detached from the image forming apparatus, the rotating member 430 and the developer discharging member 420 are rotated in one direction by the elastic force of the first and second elastic members 435 and 422, and thus the developer discharging hole 421 of the developer discharging member 420 and the opening 432*a* of the rotating member 430 are not in communication with the developer collecting hole 411, but are located again in the horizontal direction. Therefore, the developer in the developing unit 200 dose not leak to the outside through the developer discharging hole 421.

As described above, when the cartridge assembly is installed at or detached from the image forming apparatus, the shutter assembly for the image forming apparatus according to the present invention may close the developer returning passage and thus may prevent the developer of the developing unit from leaking to the outside. Also, the shutter assembly for the image forming apparatus according to the present invention may be opened and closed without a user's separate operation, when the cartridge assembly is installed and detached.

Although a few embodiments of the present invention have been shown and described, it would be appreciated by those skilled in the art that changes may be made in these embodiments without departing from the principles and spirit of the invention, the scope of which is defined in the claims and their equivalents.

The invention claimed is:

1. A shutter assembly which is installed at a cartridge assembly for an image forming apparatus to control an introduction of a developer, the cartridge assembly for an image forming apparatus comprising:

a drum unit provided with a waste toner conveying means which conveys waste toner collected from a surface of a photosensitive drum to one side;

a developing unit connected with the drum unit, configured to receive the waste toner collected from the drum unit, and having a developer discharging means to discharge a developer therein to an outside; and a developer collecting unit integrally formed with the drum unit at one side of the drum unit, and configured to collect the developer discharged by the developer discharging means of the developing unit, wherein the drum unit comprises a toner injecting means which connects the waste toner conveying means, a new toner supply unit and the developing unit so that the waste toner conveyed by the waste toner conveying means and new toner supplied from the new toner supply unit are injected together into the developing unit;

wherein the shutter assembly comprises a developer collecting member formed at a side surface of the develop collecting unit, and having a developer collecting hole;

a developer discharging member rotatably provided at an end of the developer discharging means, and having a developer discharging hole at a side surface thereof; and a rotating member rotatably installed at the side surface of the developer collecting unit, and configured to allow the developer discharging hole of the developer discharging member to be selectively in communication with the developer collecting hole.

2. The shutter assembly of claim 1, wherein the developer collecting member comprises a first seating part which is concave toward the developer collecting unit, and the developer collecting hole is formed at a lower portion of the first seating part and is longitudinally in communication with the first seating part, and the first seating part and the developer collecting hole have a quarter-circular shape.

3. The shutter assembly of claim 2, wherein the rotating member comprises a disk-shaped base having a rotating shaft which is rotatably inserted into a side surface of the developer collecting unit; and a second seating part having a shape corresponding to the first seating part, and an opening is formed at a side end of the second seating part.

4. The shutter assembly of claim 3, wherein the developer discharging member is seated at the second seating part to have a shape corresponding to the second seating part, and due to rotation of the rotating member, the developer discharging hole is closed by the first seating part, or deviates from the first seating part to be opened.

5. The shutter assembly of claim 3, wherein the rotating member further comprises a first elastic member which is connected with the rotating shaft and returns the rotating member to its original position.

6. The shutter assembly of claim 1, wherein the developer discharging member further comprises a second elastic member which is connected with the developer discharging means and returns the developer discharging means to its original position.

7. The shutter assembly of claim 1, further comprising a lever member which is connected with the rotating member, and pressed by an image forming apparatus to rotate the rotating member, when the cartridge assembly is installed at the image forming apparatus.

* * * * *